US009336961B2

(12) United States Patent
Kawamoto et al.

(10) Patent No.: US 9,336,961 B2
(45) Date of Patent: May 10, 2016

(54) BLADE-TYPE FUSE

(71) Applicant: Yazaki Corporation, Tokyo (JP)

(72) Inventors: Arata Kawamoto, Toyota (JP); Syoichi Nomura, Toyota (JP); Eiji Shimochi, Toyota (JP); Goro Nakamura, Toyota (JP)

(73) Assignee: YAZAKI CORPORATION, Tokyo (JP)

( * ) Notice: Subject to any disclaimer, the term of this patent is extended or adjusted under 35 U.S.C. 154(b) by 117 days.

(21) Appl. No.: 14/344,979

(22) PCT Filed: Oct. 12, 2012

(86) PCT No.: PCT/JP2012/076524
§ 371 (c)(1),
(2) Date: Mar. 14, 2014

(87) PCT Pub. No.: WO2013/054920
PCT Pub. Date: Apr. 18, 2013

(65) Prior Publication Data

US 2014/0361863 A1 Dec. 11, 2014

(30) Foreign Application Priority Data

Oct. 14, 2011 (JP) ..... 2011-227287

(51) Int. Cl.
*H01H 85/153* (2006.01)
*H01H 9/02* (2006.01)
(Continued)

(52) U.S. Cl.
CPC ..... *H01H 9/02* (2013.01); *H01H 61/01* (2013.01); *H01H 61/04* (2013.01); *H01H 85/11* (2013.01);
(Continued)

(58) Field of Classification Search
CPC ..... H01H 9/092; H01H 2009/0292; H01H 61/01; H01H 61/04; H01H 85/0456; H01H 85/11; H01H 85/153; H01H 85/204; H01H 85/203
USPC ..... 337/186
See application file for complete search history.

(56) References Cited

U.S. PATENT DOCUMENTS 3,829,808 A 8/1974 Blewitt et al.
5,227,759 A * 7/1993 Hatagishi ..... H01H 85/046 337/251
(Continued)

FOREIGN PATENT DOCUMENTS

CN 1071532 A 4/1993
CN 101079355 A 11/2007
(Continued)

OTHER PUBLICATIONS

Boesolt, DE 947914 C, Machine Translation.*
(Continued)

*Primary Examiner* — Anatoly Vortman
*Assistant Examiner* — Jacob Crum
(74) *Attorney, Agent, or Firm* — Sughrue Mion, PLLC

(57) ABSTRACT

In a blade-type fuse (10) according to the present invention one of an upper casing (20) and a lower casing (30) includes a fixing post (30K), the other casing includes a through-hole (20K) through which the fixing post (30K) is passed, and also the flat terminal portion (41) includes a through-hole (40K) through which the fixing post (30K) is passed. The flat terminal portion (41) is formed bilaterally symmetrically about a vertical line passing through a center of the blade-type fuse (10), and vertically symmetrically about a horizontal line passing through the center of the blade-type fuse (10).

7 Claims, 13 Drawing Sheets

(51) Int. Cl.

| | |
|---|---|
| ***H01H 61/01*** | (2006.01) |
| ***H01H 61/04*** | (2006.01) |
| ***H01H 85/11*** | (2006.01) |
| *H01H 85/20* | (2006.01) |
| *H01H 85/045* | (2006.01) |

(52) U.S. Cl.
CPC ..... *H01H 85/153* (2013.01); *H01H 85/203* (2013.01); *H01H 85/0456* (2013.01); *H01H 85/204* (2013.01); *H01H 2009/0292* (2013.01)

(56) References Cited

U.S. PATENT DOCUMENTS

| | | | | |
|---|---|---|---|---|
| 5,239,282 | A | 8/1993 | Filomia | |
| 6,270,360 | B1 * | 8/2001 | Yanase | H01H 50/047 439/76.2 |
| 6,448,882 | B1 * | 9/2002 | Inaba | H01H 85/044 337/159 |
| 2002/0080562 | A1 * | 6/2002 | Nakamura | H01H 9/10 361/626 |
| 2003/0076213 | A1 * | 4/2003 | Endo | H01H 85/2035 337/198 |
| 2006/0170528 | A1 | 8/2006 | Fukushige et al. | |
| 2006/0286868 | A1 | 12/2006 | Pentell et al. | |
| 2008/0218304 | A1 | 9/2008 | Pentell et al. | |
| 2009/0179727 | A1 | 7/2009 | Urrea et al. | |
| 2009/0179728 | A1 | 7/2009 | Urrea et al. | |
| 2010/0164678 | A1 | 7/2010 | Pentell et al. | |
| 2012/0044037 | A1 | 2/2012 | Urrea et al. | |

FOREIGN PATENT DOCUMENTS

| | | | | | |
|---|---|---|---|---|---|
| CN | 101488428 | A | | 7/2009 | |
| DE | 947914 | C | * | 8/1956 | H01H 1/42 |
| JP | 05-020247 | U | | 3/1993 | |
| JP | 2000-260534 | A | | 9/2000 | |
| JP | 2003-317604 | A | | 11/2003 | |
| JP | 2006-318768 | A | | 11/2006 | |
| JP | 2009-080959 | A | | 4/2009 | |

OTHER PUBLICATIONS

Search Report dated Jul. 3, 2015, issued by the European Patent Office in counterpart European Application No. 12839267.7.
Written Opinion (PCT/ISA/237) issued Nov. 20, 2012, in corresponding International Application PCT/JP2012/076524.
International Search Report for PCT/JP2012/076524 dated Nov. 20, 2012 [PCT/ISA/210].
Written Opinion for PCT/JP2012/076524 dated Nov. 20, 2012 [PCT/ISA/237].
Communication from the Japanese Patent Office dated May 26, 2015 in a counterpart Japanese application No. 2011-227287.
Communication issued on Jul. 2, 2015 by The State Intellectual Property Office of the PR China in related Application No. 201280050561.1.

* cited by examiner (A)

(B)

(A)

(B)

(A)

(B)

(A)

(Prior Art)

(B)

(Prior Art)

BLADE-TYPE FUSE

TECHNICAL FIELD

The present invention relates to a fuse, and particularly to a blade-type fuse.

BACKGROUND ART

<Situation of Power Supply in Recent Passenger Vehicle>

The current mainstream voltage of the power transmitted through a power transmission line of a vehicle is 14 V in the case of a usual passenger vehicle, and 14×2=28 V in the case of a heavy vehicle such as a bus or a truck. In passenger vehicles, particularly, a power supply system which supplies power at a voltage which is higher than a conventional one, such as 42 V has begun to be employed because of demands for improving the efficiency of driving the load, and for driving at an efficiency which is optimum for respective loads.

In a power transmission line, therefore, an electric junction box (for example, a fuse block) in which many fuses are disposed in a pluggable/unpluggable manner, or mini fuses are used in order to protect electric circuits of various electrical components.

<Conventional Blade-Type Fuse 100>

As a conventional blade-type fuse which is to be used in an electric junction box or a mini fuse, a blade-type fuse 100 is shown in FIG. 11 (see Patent Literatures 1 and 2).

The blade-type fuse 100 exemplarily shown in FIG. 11 is a low-height type fuse in which the flattened fuse body 400 is held between two upper and lower insulating casings 200, 300 consisting of front and back sides, respectively.

<Fuse Body 400>

In the fuse body 400, a fusible portion 420 is disposed so as to lay across the facing inner edges of a pair of flat terminal portions 410, 410 which have a substantially rectangular shape, and which are parallel to each other. Through-holes 400K, 400K are formed in the upper and lower sides of each of the flat terminal portions 410, respectively.

<Upper and Lower Casings 200, 300>

Each of the upper and lower casings 200, 300 has a T-like shape as a whole as indicated by the hatching showing a transparent resin in FIG. 11. The casings are paired in the front and back side, and used while being coupled to each other.

Through-holes 200K are formed in one of the upper and lower casings (for example, the upper casing 200), and fixing posts 300K are formed in the other casing (for example, the lower casing 300), and the fuse body 400 is interposed between the casings. The fixing posts 300K of the lower casing 30 are passed through the through-holes 400K of the fuse body 400 to be fitted into the through-holes 200K of the upper casing 200, so that the upper and lower casings 200, 300 house the fuse body 400.

<Use of Blade-Type Fuse 100 in Electric Junction Box or Mini Fuse>

When the lower end side of the blade-type fuse 100 is housed in a housing portion in an electric junction box, the flat terminal portions 410, 410 which are in the ends of the fuse are inserted into two female terminals existing in the housing portion to be electrically connected to each other, respectively.

When the lower end side of the blade-type fuse 100 is inserted into a mini fuse, the flat terminal portions 410, 410 which are in the ends of the fuse are inserted into two bifurcated terminals disposed in the mini fuse to be electrically connected to each other, respectively. FIGS. 12(A) and 12(B) are perspective views showing a state where the conventional blade-type fuse 100 are inserted into two bifurcated terminals, FIG. 12(A) is a perspective view showing a state before the insertion into the bifurcated terminals, and FIG. 12(B) is a perspective view showing a state after the insertion.

In FIGS. 12(A) and 12(B), tapered parts of the lower ends of the flat terminal portions 410 of the blade-type fuse 100 are inserted into inlet openings 50E of the bifurcated terminals 50, and lowered in the direction as indicated by the white arrow. Then, thick parts of the flat terminal portions 410 push and expand bifurcated tip parts 50R and 50L of the bifurcated terminals 50 in directions of separating from each other, and finally stop. As a result, the blade-type fuse 100 and the bifurcated terminals 50 are electrically connected to each other as shown in FIG. 12(B). The position where the fitting stops is usually restricted by cavities.

The upper end side of the blade-type fuse 100 is swollen by a molding resin in the thickness and width directions the flat terminal portions 410. Therefore, in the case of replacing a fuse, for example, a worker can easily pull out the fuse from the terminals by nipping a swollen part 200T (see FIG. 11).

CITATION LIST

Patent Literature

Patent Literature 1: JP-A-2003-317604

Patent Literature 2: JP-A-2009-80959

SUMMARY OF INVENTION

Technical Problem

<Advantage of Blade-Type Fuse 100>

According to the conventional blade-type fuse 100 of FIG. 11, in the case where the fuse is to be connected to an electric junction box or a mini fuse, it is possible to perform two-direction connection in which, when the blade-type fuse 100 is inserted while downward directing the lower ends 400S, an electrical connection can be established irrespective of the front side or the back side.

<Disadvantage of Blade-Type Fuse 100>

By contrast, when the blade-type fuse 100 of FIG. 11 is upside down and to be inserted into mating female terminals while downward directing the upper side of the blade-type fuse 100, the swollen part 200T in the upper end side of the blade-type fuse 100 interferes with the insertion, and an electrical connection cannot be established. That is, four-direction connection is disabled.

Technical Problem

<<First Object>>

The present invention has been conducted in view of the above-discussed circumstances. It is a first object of the present invention to provide a blade-type fuse which can be connected to mating female terminals in any of the upward, downward, leftward, and rightward directions or four directions, and in which the connection can be realized by a simple configuration.

<<Second Object>>

Furthermore, it is a second object of the present invention to provide a terminal structure in which flat terminal portions of a blade-type fuse which are inserted into bifurcated terminals can be prevented from vibrating, and heat generations is suppressed. FIG. 13(A) is a side view of the flat terminal portion inserted into the bifurcated terminal in FIG. 12(B). In FIG. 13(A), the contact surface of each of the bifurcated tip parts 50R and 50L of the bifurcated terminal 50 has a curved surface C, and is in point contact with the flat terminal portion 410 of the blade-type fuse. Therefore, the contact area is narrow, and the electric resistance is high, so that heat generation occurs here.

Since the contact area is narrow, the bifurcated tip parts 50R, 50L of the bifurcated terminal 50 easily move on the surface of the flat terminal portion 410. Normally, the bifurcated tip parts 50R, 50L of the bifurcated terminal 50 are on the center line 50C as shown in FIG. 13(B)(1), and press in mutually opposite directions the flat terminal portion 410 to stably hold it. When vibrations occur for any reason, the bifurcated tip parts 50R, 50L of the bifurcated terminal 50 move in the respective directions in which they separate from the center line 50C as shown in FIG. 13(B)(2). As a result, the parts press the flat terminal portion 410 on the different lines of action in opposite directions, and a couple of force is generated, so that the portion is not stably held, flopping occurs, and heat is generated.

Therefore, it is a second object of the present invention to provide a terminal structure in which flat terminal portions of a blade-type fuse which are inserted into bifurcated terminals can be prevented from vibrating, and heat generations is suppressed.

Solution to Problem

In order to achieve the above objects, the present invention is characterized by any aspects (1) to (4) as follows.

(1) A blade-type fuse including: an upper casing; a lower casing which is engaged with the upper casing; and a fuse body having a fusible portion which is housed between the upper casing and the lower casing, and a flat terminal portion which is exposed from between the upper casing and the lower casing, wherein one of the upper casing and the lower casing includes a fixing post, the other of the upper casing and the lower casing includes a through-hole through which the fixing post is passed, the flat terminal portion includes a through-hole through which the fixing post is passed, and the flat terminal portion is formed bilaterally symmetrically about a vertical line passing through a center of the blade-type fuse, and vertically symmetrically about a horizontal line passing through the center of the blade-type fuse.

(2) In the aspect (1) of the present invention, a terminal guide groove which guides bifurcated tip parts of a bifurcated terminal is disposed in the flat terminal portion and extended in an insertion direction from a contact part of the terminal guide groove contact with the bifurcated terminal when the flat terminal portion is inserted.

(3) In the aspect (2) of the present invention, fitting recesses are formed in parts of the terminal guide groove at which contact surfaces of the bifurcated tip parts of the bifurcated terminals are positioned respectively in an optimum stop position state where the flat terminal portion stops after being inserted into the bifurcated terminal.

(4) In the aspect (3) of the present invention, the contact surfaces of the bifurcated tip parts of the bifurcated terminal is made identical in shape with the fitting recesses of the terminal guide groove, and in surface contact with each other.

Advantageous Effects of Invention

According to the aspect (1) of the present invention, it is possible to obtain a blade-type fuse which can be connected in any of the upward, downward, leftward, and rightward directions or four directions of the blade-type fuse, and which has a simple configuration.

According to the aspect (2) of the present invention, since the terminal guide groove is disposed, the bifurcated tip parts of the bifurcated terminal are restricted into the terminal guide groove. Therefore, the bifurcated tip parts do not step out of the terminal guide grooves, and rattling does not occur.

According to the aspect (3) of the present invention, since the fitting recesses are further formed in the terminal guide groove, the bifurcated tip parts of the bifurcated terminal can be located easily and surely at the optimum positions of the flat terminal portion of the blade-type fuse.

According to the aspect (4) of the present invention, since the contact surfaces of the bifurcated tip parts of the bifurcated terminal are made identical in shape with the fitting recesses of the terminal guide groove, the contact area is widened. Therefore, the electric resistance is lowered, and heat generation is suppressed.

BRIEF DESCRIPTION OF DRAWINGS

FIG. 7(A) is a front view of a state where the blade-type fuse of FIG. 6(A) is inserted in a normal state into the bifurcated terminals in the lower side, FIG. 7(B) is a front view of a state where the blade-type fuse 10 of FIG. 6(B) is inserted in a normal state into the bifurcated terminals in the lower side, FIG. 7(C) is a front view of a state where the blade-type fuse of FIG. 6(A) in an upside down state is inserted into the bifurcated terminals in the lower side, and FIG. 7(D) is a front view of a state where the blade-type fuse of FIG. 6(B) in an upside down state is inserted into the bifurcated terminals in the lower side.

Figure 13:
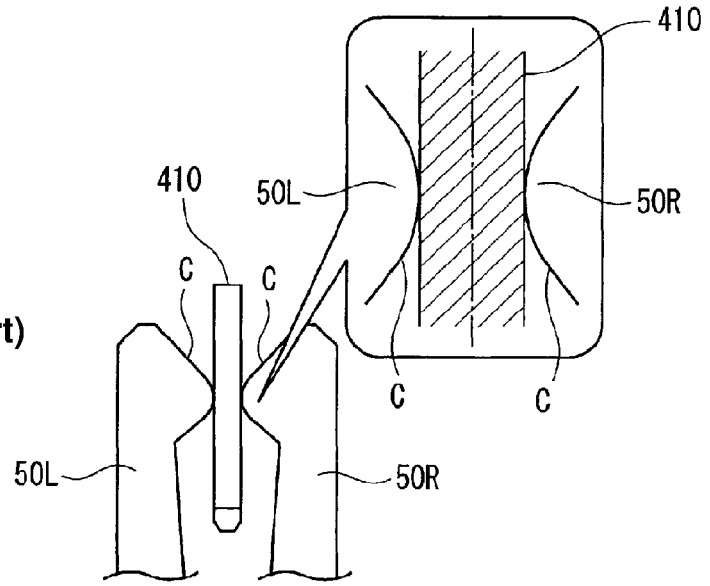
FIG. 13(A) is a side view of a flat terminal portion of the conventional blade-type fuse inserted into the bifurcated terminal, FIGS. 13(B)(1) and 13(B)(2) are front views, FIG.
Figure 13:
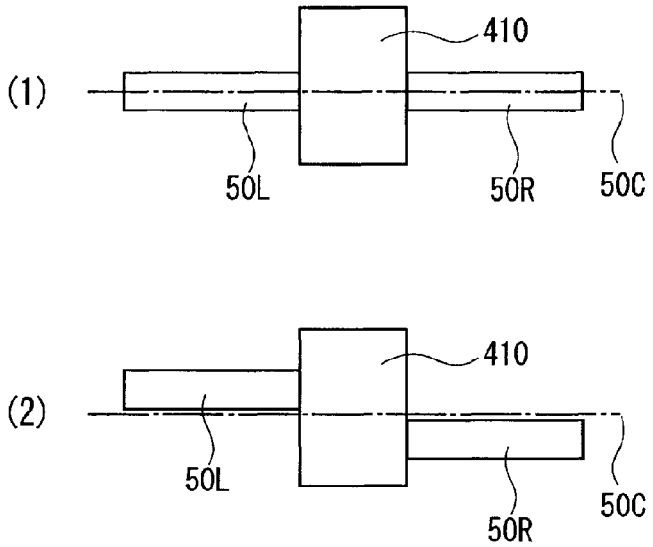

13(B)(1) shows the normal state, and FIG. 13(B)(2) shows a state where flopping due to vibrations occurs.

DESCRIPTION OF EMBODIMENTS

First Embodiment

Hereinafter, a blade-type fuse of the present invention will be described in detail with reference to the drawings.

Figure 1:
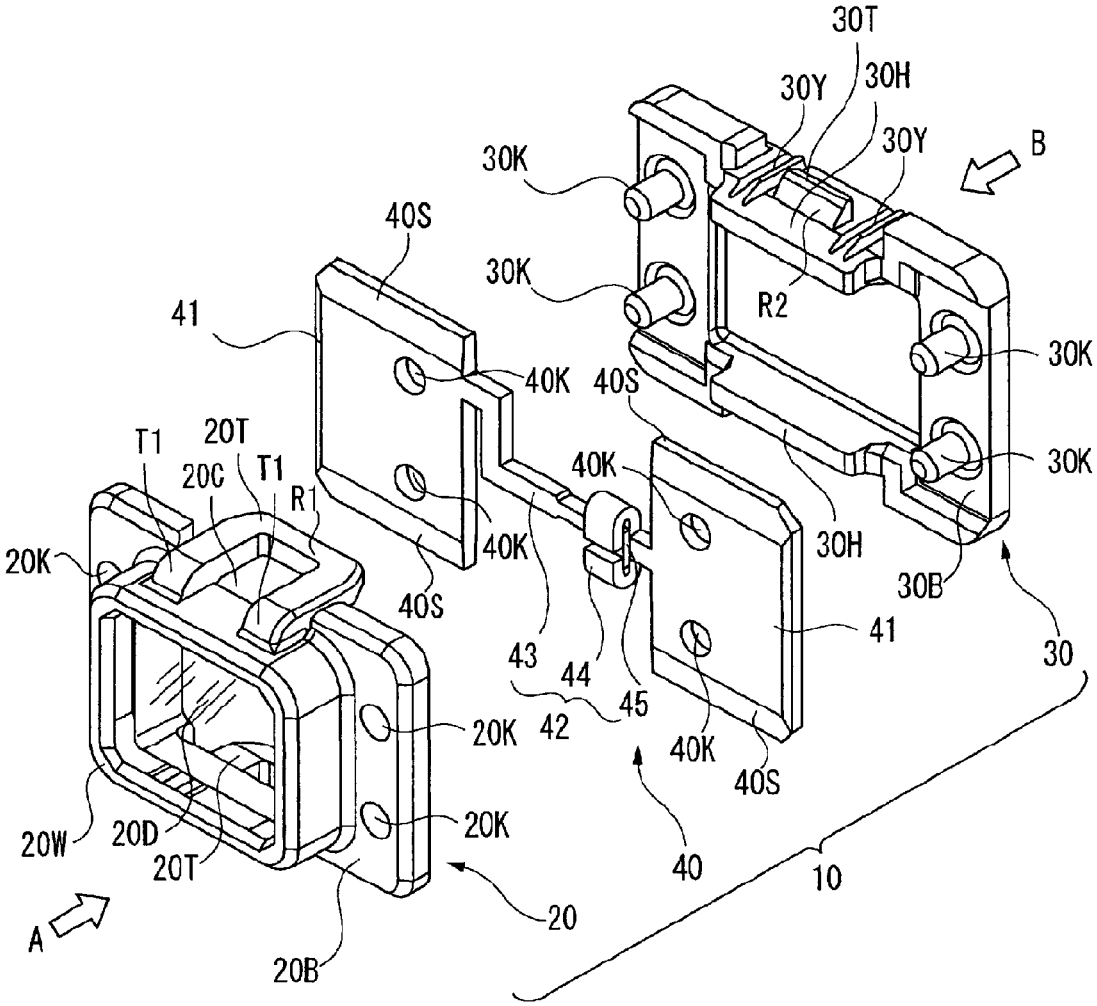
FIG. 1 is an exploded perspective view of a blade-type fuse according to a first embodiment of the present invention.

FIG. 1 is an exploded perspective view of a blade-type fuse according to a first embodiment of the present invention.

In FIG. 1, a blade-type fuse 10 includes an upper casing 20, a lower casing 30 which is engaged with the upper casing 20, and a fuse body 40 which is housed between the upper casing 20 and the lower casing 30.

The fuse body 40 is sandwiched between the upper casing 20 and the lower casing 30. When the fuse body 40 is to be sandwiched, four fixing posts 30K of the lower casing 30 are passed through through-holes 40K of flat terminal portions 41, and fitted into four through-holes 20K of the upper casing 20, and engagement pieces 20T of the upper casing 20 are engaged with engagement projections 30T of the lower casing 30, thereby completing the blade-type fuse 10 of FIG. 2.

Then, the upper casing 20, the lower casing 30, and the fuse body 40 will be described in detail.

<Configuration of Upper Casing 20 in the Present Invention>

Figure 3:
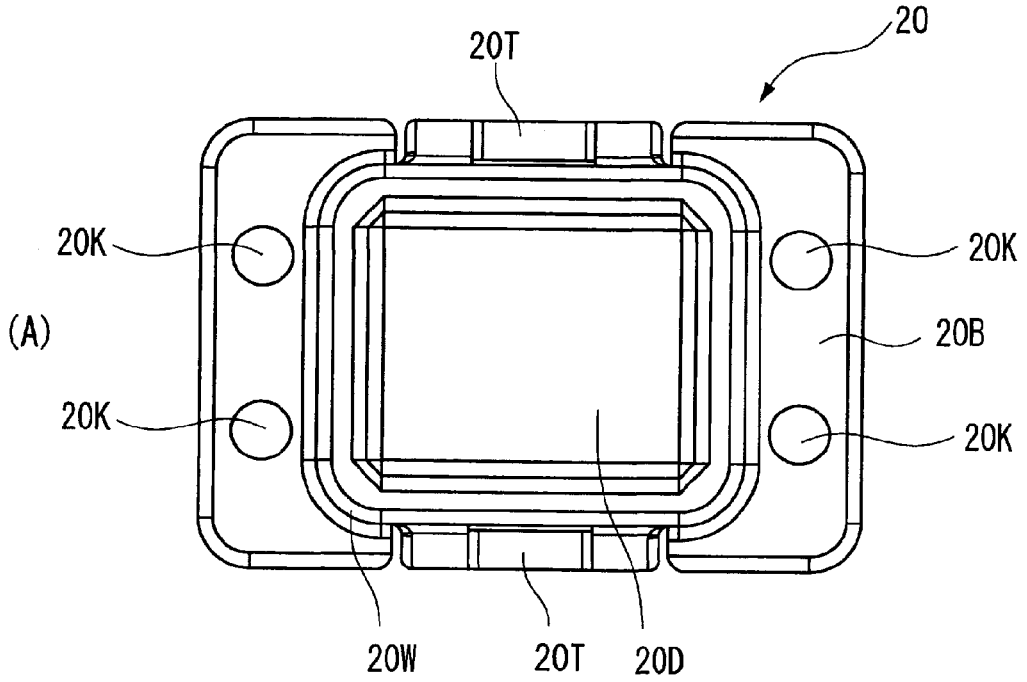
FIG. 3(A) is a front view of an upper casing in FIG. 1.
FIG. 3(B) is a back view of the upper casing.
Figure 3:
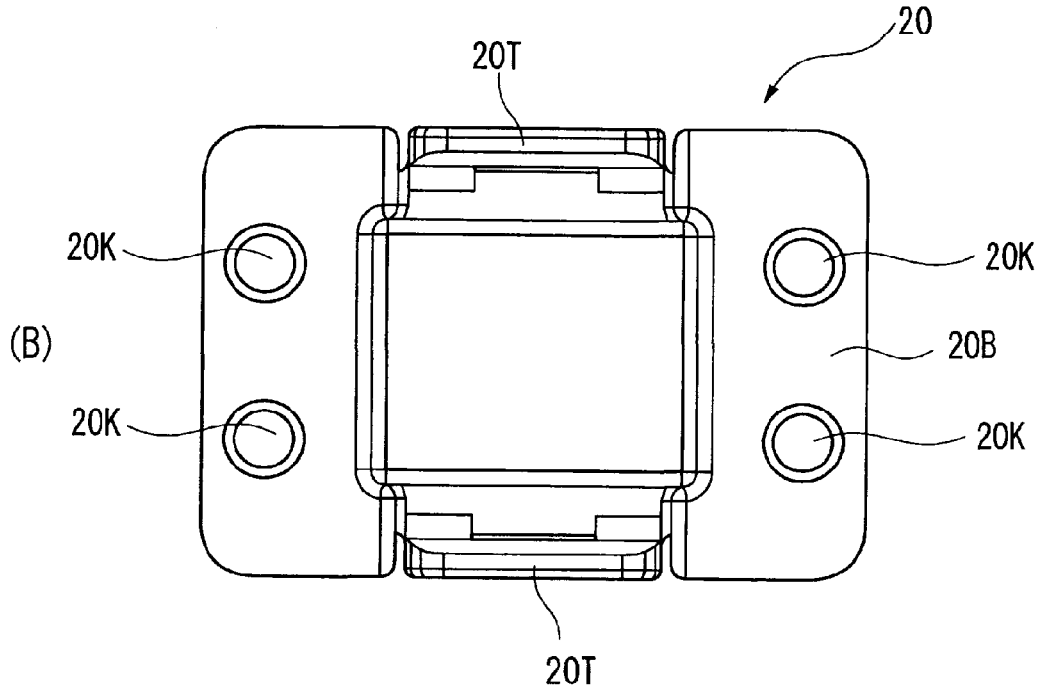

FIG. 3(A) is a front view of the upper casing, and FIG. 3(B) is a back view of the upper casing.

In FIGS. 3(A) and 3(B), the upper casing 20 is molded by a resin. The upper casing 20 includes: a rectangular base portion 20B; a rectangular window frame portion 20W which perpendicularly upstands from vicinities of the four sides of the base portion 20B; a transparent cover portion 20D which covers the interior of the window frame portion 20W; the U-like engagement pieces 20T which are disposed above and below the window frame portion 20W, respectively, and which are horizontally extended toward the lower casing 30; and the total of four through-holes 20K which are vertically formed between the base portion 20B and the window frame portion 20W.

In order to enable the engagement pieces 20T to be horizontally extended, cutaways 20C are formed in corresponding parts of the base portion 20B.

<<Configuration of U-Like Engagement Pieces 20T>>

In the U-like engagement pieces 20T, tip ends of both leg portions T1, T1 (FIG. 1) are integrally joined to the window frame portion 20W, and intermediate coupling portions R1 (FIG. 1) are horizontally extended in the direction of the lower casing 30. In the case where the engagement pieces 20T are to be engaged with the engagement projections 30T of the lower casing 30, when the lower parts of the intermediate coupling portions R1 butt against tapered parts of the engagement projections 30T, the engagement pieces 20T are slightly raised because of the elastic force of the resin itself, the engagement projections 30T pass under the intermediate coupling portions R1 and are again raised, and then the engagement pieces 20T return to the original shape, thereby completing the engagement.

<Configuration of Lower Casing 30 in the Present Invention>

Figure 4:
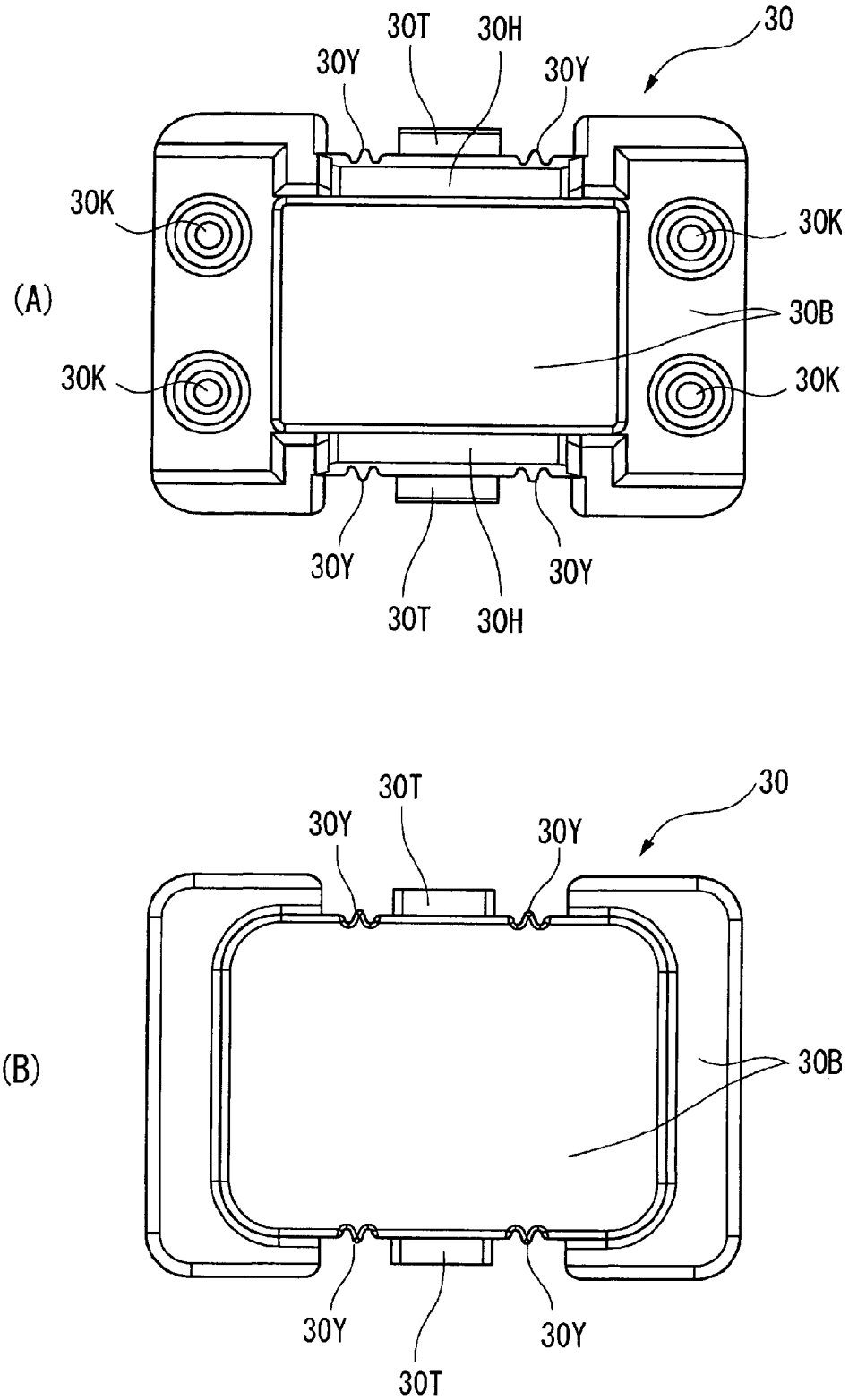
FIG. 4(A) is a front view of a lower casing in FIG. 1.
FIG. 4(B) is a back view of the lower casing.

FIG. 4(A) is a front view of the lower casing, and FIG. 4(B) is a back view of the lower casing.

In FIGS. 4(A) and 4(B), the lower casing 30 is molded by a resin in the same manner as the upper casing 20. The lower casing 30 includes: a rectangular base portion 30B; and extended portions 30H which are extended from the upper and lower sides of the base portion 30B toward the upper casing 20, respectively. On the front sides of the extended portions 30H, engagement projections 30T which are to be engaged with the engagement pieces 20T disposed in the upper and lower sides of the upper casing 20 are formed, and rattling preventing ribs 30Y are formed in the both ends of the engagement projections 30T.

The lower casing 30 further includes the fixing posts 30K which are passed through and fitted into the four through-holes 20K of the upper casing 20, respectively, in four parts or upper, lower, right, and left parts of the base portion 30B.

<<Configuration of Engagement Projections 30T>>

The engagement projections 30T are projections which are formed in the front sides of the extended portions 30H which are extended in a cantilever support from the base portion 30B, and which are triangular or trapezoidal in section. The tapered parts R2 (FIG. 1) each configured by one side of the triangle or the trapezoid are formed at the tip ends in the engagement direction. The extended portions 30H are configured so that, when, in the engagement with the engagement pieces 20T of the upper casing 20, the tapered parts R2 of the engagement projections 30T butt against the intermediate coupling portions R1, the extended portions can be slightly lowered because of the elastic force of the resin itself. Therefore, the intermediate coupling portions R1 are raised, and the engagement projections 30T are pushed down. Hence, the engagement projections 30T can pass under the intermediate coupling portions R1. Then, the engagement projections 30T are again raised, and then the intermediate coupling portions R1 and the extended portions 30H return to their original shapes, thereby completing the engagement between the engagement pieces 20T and the engagement projections 30T.

<Configuration of Fuse Body 40 in the Present Invention>

Returning to FIG. 1, the fuse body 40 is configured by the pair of parallel flat terminal portions 41, and a fusible portion 42 which is integrally formed between the flat terminal portions 41, 41.

Hereinafter, the flat terminal portions 41 and the fusible portion 42 will be described.

<<Configuration of Flat Terminal Portions 41>>

In FIG. 1, each of the left and right flat terminal portions 41, 41 is a rectangular metal plate. The left and right flat terminal portions 41, 41 include the through-holes 40K into which the fixing posts 30K of the lower casing 30 are to be inserted, in the upper and lower sides of each portion. Inclined portions 40S in which the thickness is reduced toward the tip end are formed in the upper and lower sides of the left and right flat terminal portions 41, 41, respectively, so that the flat terminal portions 41 can be easily inserted between counter terminals.

<<Configuration of Fusible Portion 42>>

The fusible portion 42 is configured by integrally forming a band-like coupling portion 43 which couples in a crank-like shape between the left and right flat terminal portions 41, 41, and which has a thin band-like shape, and a short supporting piece 44 which is extended in the both directions from a middle of the band-like coupling portion 43 perpendicularly with respect to the longitudinal direction. The fusible portion 42 further internally holds a low-melting-point metal chip 45 by means of crimping of the short supporting piece 44.

The low-melting-point metal chip 45 is configured by a metal (tin, a tin alloy, or the like) which is lower in melting point than the flat terminal portions 41 and the band-like coupling portion 43, and, after crimping, exposed to the melting temperature of the low-melting-point metal chip for a short time period to be fusion bonded to the surface of the supporting piece 44.

When a current flowing through the pair of flat terminal portions 41, 41 exceeds a predetermined current value and flows over a predetermined time period, the low-melting-point metal chip 45 melts to increase the electric resistance, and finally the band-like coupling portion 43 of the fusible portion 42 melts down, thereby interrupting the current.

<Assembly of Blade-Type Fuse 10>

When the blade-type fuse 10 is to be assembled, the fuse body 40 is sandwiched between the upper casing 20 and the lower casing 30, the four fixing posts 30K of the lower casing 30 are inserted into the four through-holes 40K of the fuse body 40, and further passed through and fitted into the four through-holes 20K of the upper casing 20, and at the same time the upper and lower engagement pieces 20T of the upper casing 20 are engaged with the upper and lower engagement projections 30T of the lower casing 30, thereby completing the assembly. At this time, the upper and lower engagement pieces 20T of the upper casing 20 are urged in the raising direction by the rattling preventing ribs 30Y, and therefore the engagement pieces 20T do not rattle.

<Advantage of Blade-Type Fuse 10>

Figure 2:
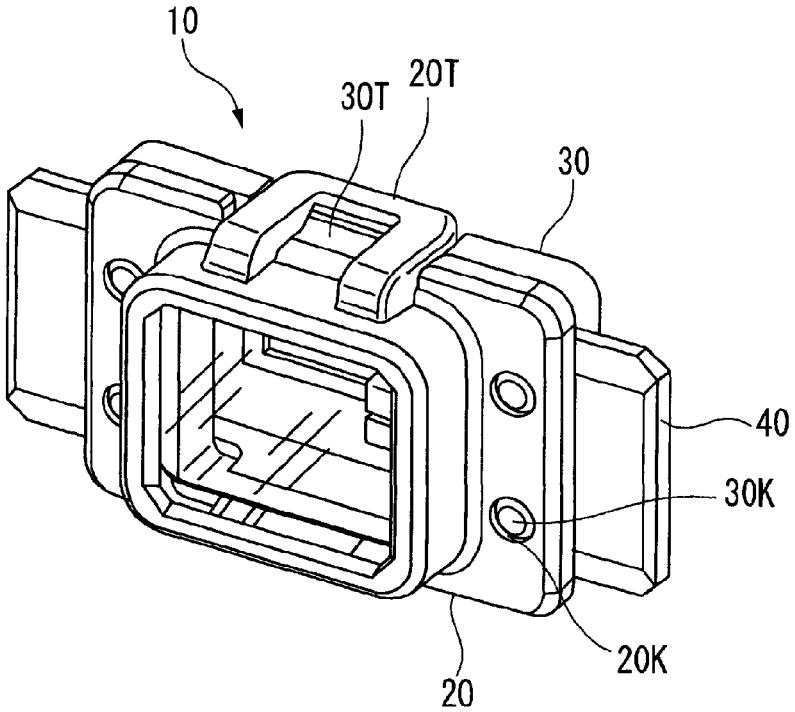
FIG. 2 is a perspective view of the blade-type fuse after the disassembled blade-type fuse of FIG. 1 is assembled.
Figure 5:
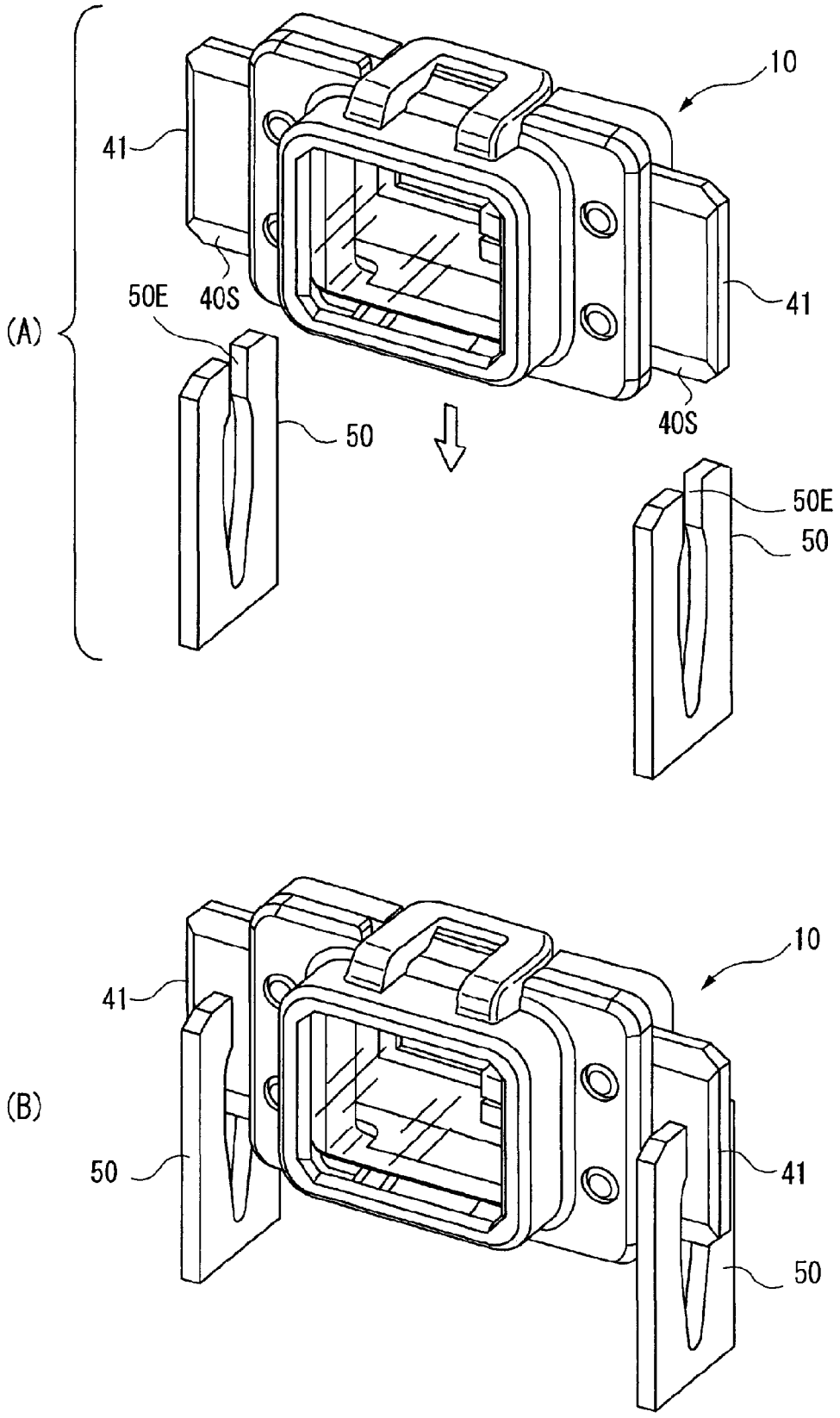
FIG. 5(A) is a perspective view of a state before the blade-type fuse of FIG. 2 is inserted into bifurcated terminals.
FIG. 5(B) is a perspective view of a state after the insertion.
Figure 6:
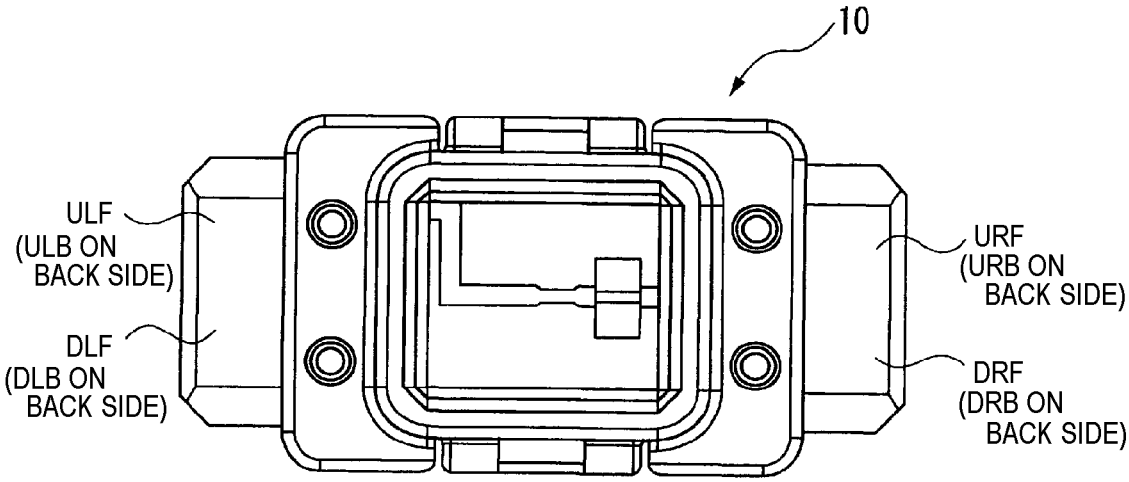
FIG. 6(A) is a front view of the blade-type fuse of FIG. 2.
FIG. 6(B) is a back view of the blade-type fuse.
Figure 6:
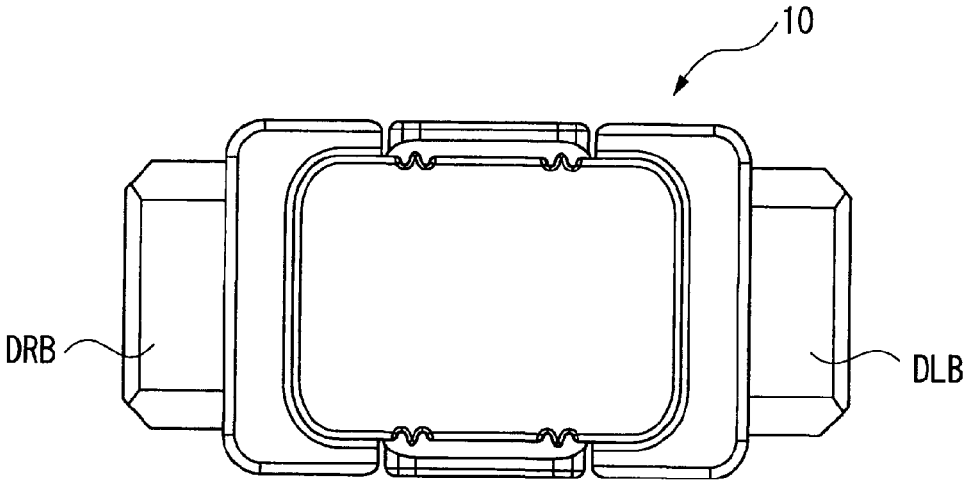
Figure 7:
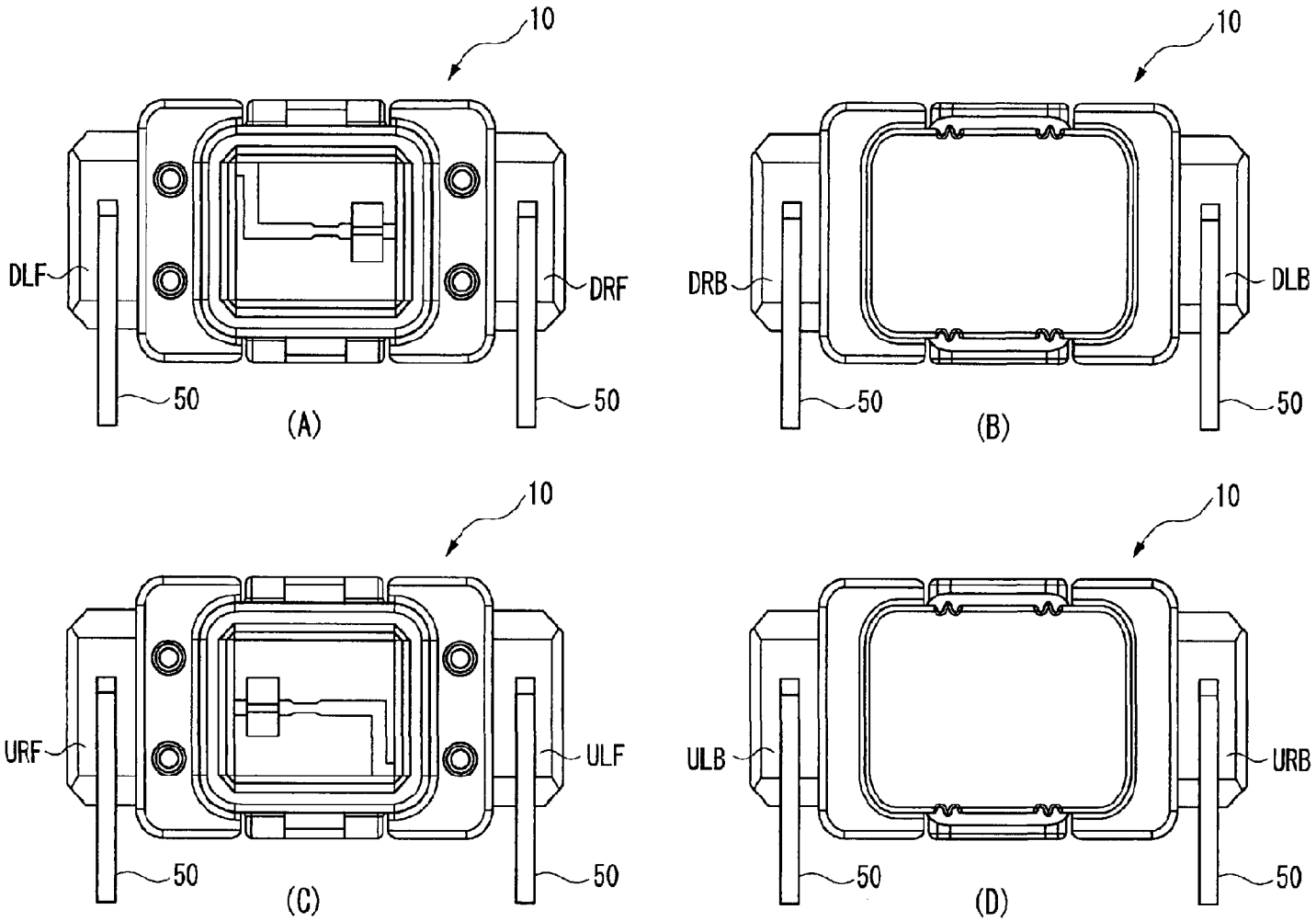
FIGS. 7(A) to 7(D) are front views illustrating that the blade-type fuse can be inserted into the bifurcated terminals in the upward, downward, leftward, and rightward directions or four directions.

FIG. 5(A) is a perspective view of a state before the blade-type fuse of FIG. 2 is inserted into the bifurcated terminals, and FIG. 5(B) is a perspective view of a state after the insertion. When the blade-type fuse 10 is lowered toward the two bifurcated terminals 50 in the lower side, the inclined portions 40S of the terminal portions 41, 41 are introduced into inlet openings 50E of the bifurcated terminals 50. When the blade-type fuse 10 is further lowered, the thick parts of the terminal portions 41, 41 expand the inlet openings 50E, and then stop. As a result, the electrical connection of the blade-type fuse 10 and the bifurcated terminals 50 is completed. FIG. 5(B) shows this state.

In the blade-type fuse 10 according to the present invention, the flat terminal portions 41 are formed in a vertically and bilaterally symmetrical shape as described later. When the blade-type fuse 10 is to be inserted into the bifurcated terminals 50, therefore, the insertion can be performed without concern for the direction (the front side or the back side, the upper side or the lower side) of the blade-type fuse 10.

Advantages of the present invention will be described with reference to FIG. 6(A) to FIG. 7(D).

<Definition of Left and Right Flat Terminal Portions of Blade-Type Fuse 10>

FIG. 6(A) is a front view of the blade-type fuse, and FIG. 6(B) is a back view of the fuse. Here, it is defined that the character U means the upper part of a flat terminal portion in FIG. 6(A), the character D means the lower part of the flat terminal portion in FIG. 6(A), the character L means the left part of the flat terminal portion in FIG. 6(A), the character R means the right part of the flat terminal portion in FIG. 6(A), the character F means the front side of the flat terminal portion in FIG. 6(A), and the character R means the back side of the flat terminal portion in FIG. 6(A). In FIG. 6(A), four parts or the upper left, upper right, lower left, and lower right parts of the flat terminal portions on the front sides of the flat terminal portions of the blade-type fuse 10 are ULF, URF, DLF, and DRF, respectively. In the flat terminal portions, the corresponding parts which are the back sides of the parts ULF, URF, DLF, and DRF of the flat terminal portions are ULB, URB, DLB, and DRB, respectively.

When the blade-type fuse 10 of FIG. 6(A) is turned over to reverse the left-to-right orientation, FIG. 6(B) is obtained. In FIG. 6(B), the lower left part of the blade-type fuse 10 is DRB which is defined in FIG. 6(A), and the lower right part is DLB which is defined in FIG. 6(A).

In FIGS. 6(A) and 6(B), it is seen that the blade-type fuse 10 is bilaterally symmetrical about the vertical center line, and vertically symmetrical about the horizontal center line.

<Insertable Without Concern for Front Side or Back Side of Blade-Type Fuse 10>

FIGS. 7(A) to 7(D) are front views illustrating that the blade-type fuse can be inserted into the bifurcated terminals in the upward, downward, leftward, and rightward directions or four directions, FIG. 7(A) is a front view of a state where the blade-type fuse of FIG. 6(A) is inserted in a normal state into the bifurcated terminals in the lower side, FIG. 7(B) is a front view of a state where the blade-type fuse 10 of FIG. 6(B) is inserted in a normal state into the bifurcated terminals in the lower side, FIG. 7(C) is a front view of a state where the blade-type fuse of FIG. 6(A) in an upside down state is inserted into the bifurcated terminals in the lower side, and FIG. 7(D) is a front view of a state where the blade-type fuse of FIG. 6(B) in an upside down state is inserted into the bifurcated terminals in the lower side.

The lower left part DLF of the front side of the blade-type fuse 10 of FIG. 7(A), and the lower left part DRB of the back side of the blade-type fuse 10 of FIG. 7(B) have the same shape and dimensions, and the lower right part DRF of the front side of the blade-type fuse 10 of FIG. 7(A), and the lower right part DLB of the back side of the blade-type fuse 10 of FIG. 7(B) have the same shape and dimensions. Therefore, the blade-type fuse 10 can be inserted into the bifurcated terminals 50 to be electrically connected to each other without concern for the front side or back side of the blade-type fuse 10. This operation can be performed in the conventional blade-type fuse of FIG. 11.

<Insertable Without Concern for Upper Side or Lower Side of Front Side of Blade-Type Fuse 10>

The lower left part DLF of the front side of the blade-type fuse 10 of FIG. 7(A), and the lower left part URF of the front side of the blade-type fuse 10 of FIG. 7(C) have the same shape and dimensions, and the lower right part DRF of the front side of the blade-type fuse 10 of FIG. 7(A), and the lower right part ULF of the front side of the blade-type fuse 10 of FIG. 7(C) have the same shape and dimensions. Therefore, the blade-type fuse 10 can be inserted into the bifurcated terminals 50 to be electrically connected to each other without concern for the upper side or lower side of the front side of the blade-type fuse 10.

Figure 11:
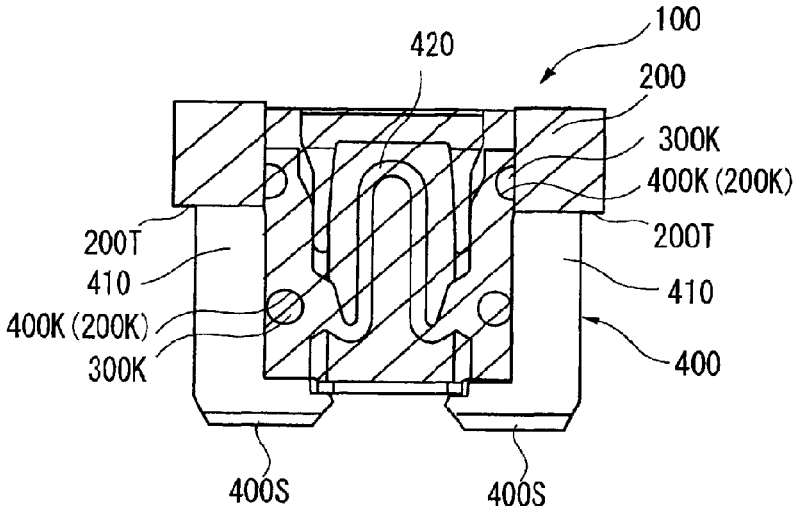
FIG. 11 (Prior Art)
FIG. 11 is a front view of a conventional blade-type fuse.
Figure 12:
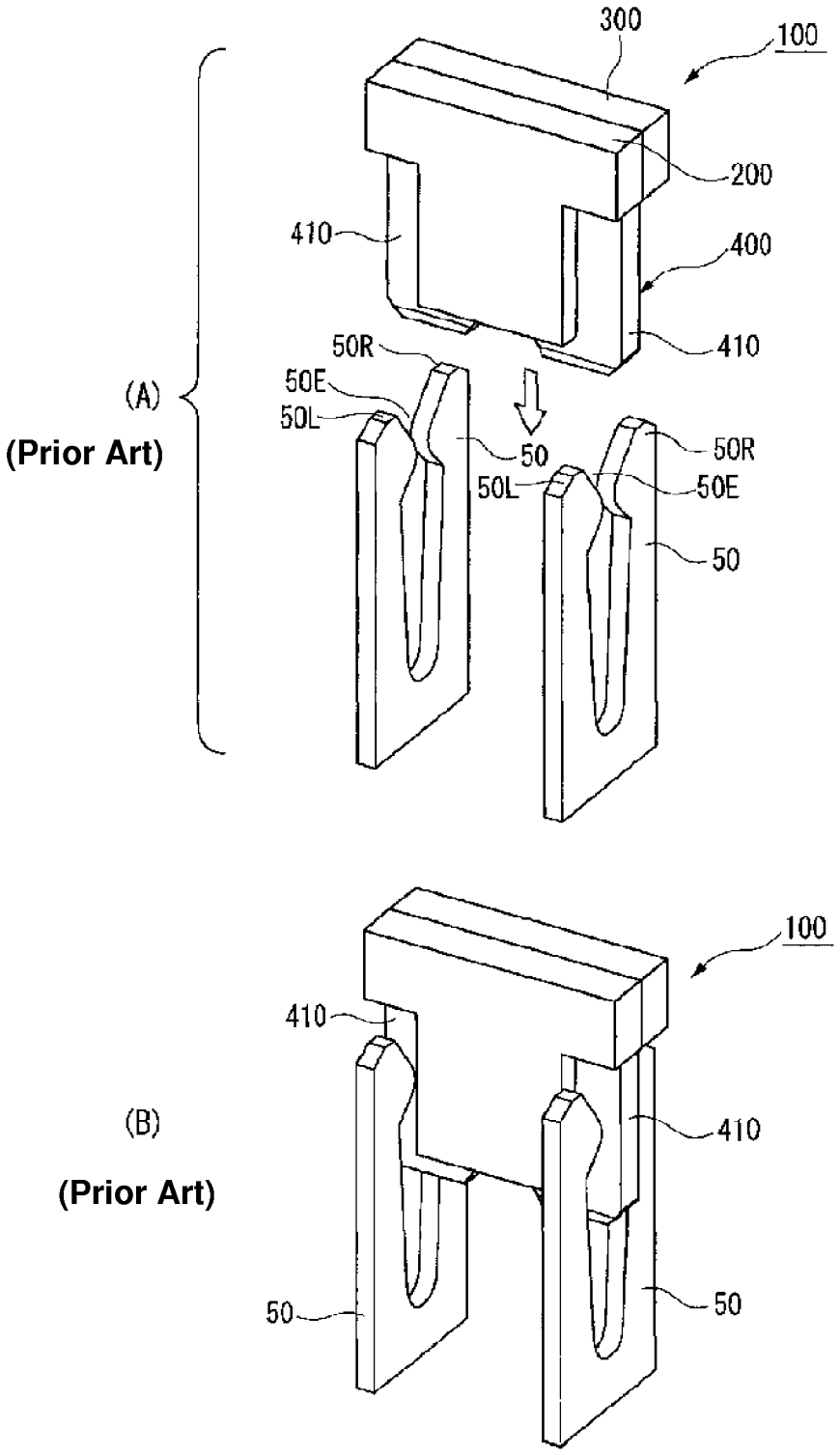
FIG. 12(A) is a perspective view of a state before the blade-type fuse of FIG. 11 is inserted into bifurcated terminals.
FIG. 12(B) is a perspective view of a state after the insertion.

This operation cannot be performed in the conventional blade-type fuse of FIG. 11.

<Insertable While Blade-Type Fuse 10 is Turned Over and Upside Down>

The lower left part DLF of the front side of the blade-type fuse 10 of FIG. 7(A), and the lower left part 4ULB of the back side of the blade-type fuse 10 of FIG. 7(D) have the same shape and dimensions, and the lower right part DRF of the front side of the blade-type fuse 10 of FIG. 7(A), and the lower right part URB of the back side of the blade-type fuse 10 of FIG. 7(D) have the same shape and dimensions. Therefore, the blade-type fuse 10 can be inserted into the bifurcated terminals 50 to be electrically connected to each other even when the blade-type fuse 10 is turned over and upside down.

This operation cannot be performed in the conventional blade-type fuse of FIG. 11.

Summary of First Embodiment

According to the present invention, as described above, it is possible to provide a blade-type fuse in which flat terminal portions are formed bilaterally symmetrically about a vertical line passing through the center of the fuse, and vertically symmetrically about a horizontal line, which therefore can be connected in any of the upward, downward, leftward, and rightward directions or four directions of the blade-type fuse, and which has a simple configuration.

Second Embodiment

Figure 8:
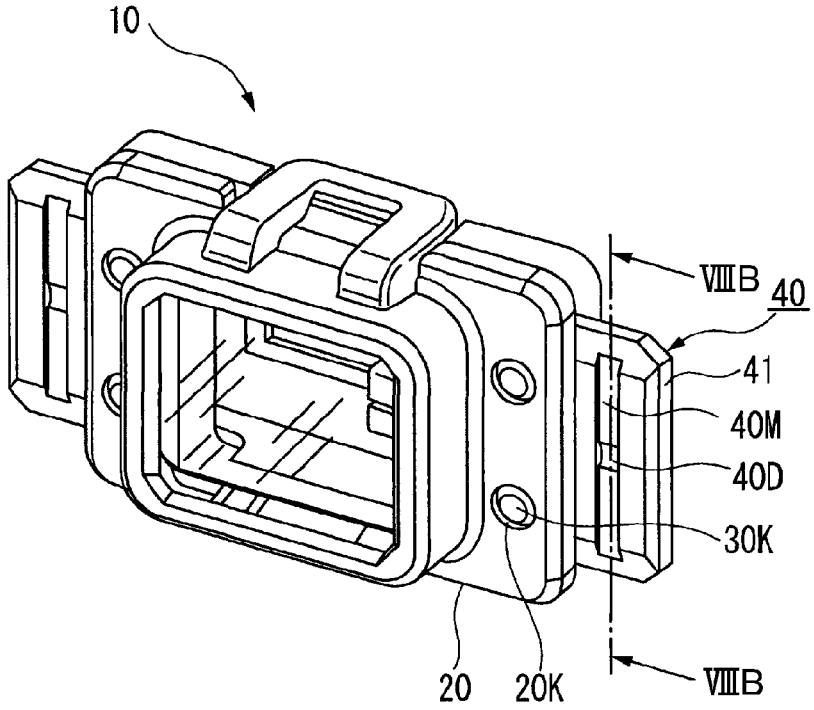
FIG. 8(A) is a perspective view of a blade-type fuse according to a second embodiment of the present invention.
FIG. 8(B) is a longitudinal sectional view of a flat terminal portion of a fuse body.
Figure 8:
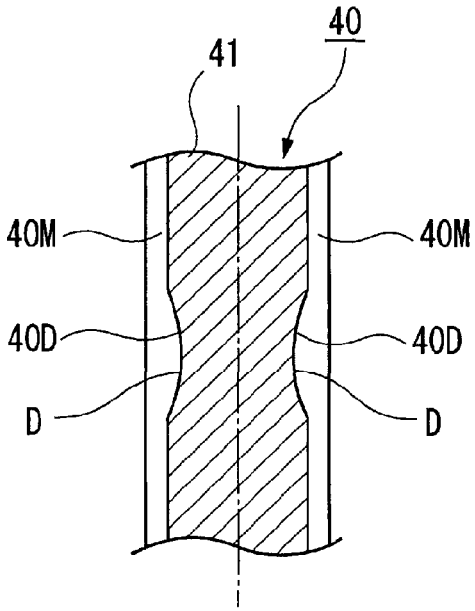

FIG. 8(A) is a perspective view of a blade-type fuse according to a second embodiment of the present invention.

In the figure, the blade-type fuse according to the second embodiment is characterized in that terminal guide grooves 40M (FIG. 8(A)) which guide the bifurcated tip parts 50R, 50L of the bifurcated terminals 50 (FIG. 5(A)) are disposed in the flat terminal portions 41 in parts (FIG. 5(B)) where the bifurcated tip parts 50R, 50L of the bifurcated terminals 50 are in contact with one ends of the flat terminal portions 41, inserted, and finally stop, so as to extend from the one ends of the flat terminal portions 41 to the opposite ends in the insertion direction.

In the terminal guide grooves 40M, fitting recesses 40D are formed in parts which are in contact with the bifurcated tip parts 50R, 50L of the bifurcated terminals 50 respectively in an optimum stop position state where the flat terminal portions 41 are inserted into the bifurcated terminals 50 and stop.

FIG. 8(B) is a longitudinal sectional view taken along VIIIB-VIIIB in FIG. 8(A). In the figure, the terminal guide grooves 40M are vertically formed in the flat terminal portion 41, and, in the terminal guide grooves 40M, the fitting recesses 40D are formed in the parts (left and right in the figure) which are in contact with the bifurcated tip parts 50R, 50L of the bifurcated terminal 50 in the optimum stop position state where the flat terminal portions 41 are inserted into the bifurcated terminals 50 and stop.

<Advantage of Blade-Type Fuse 10>

Figure 9:
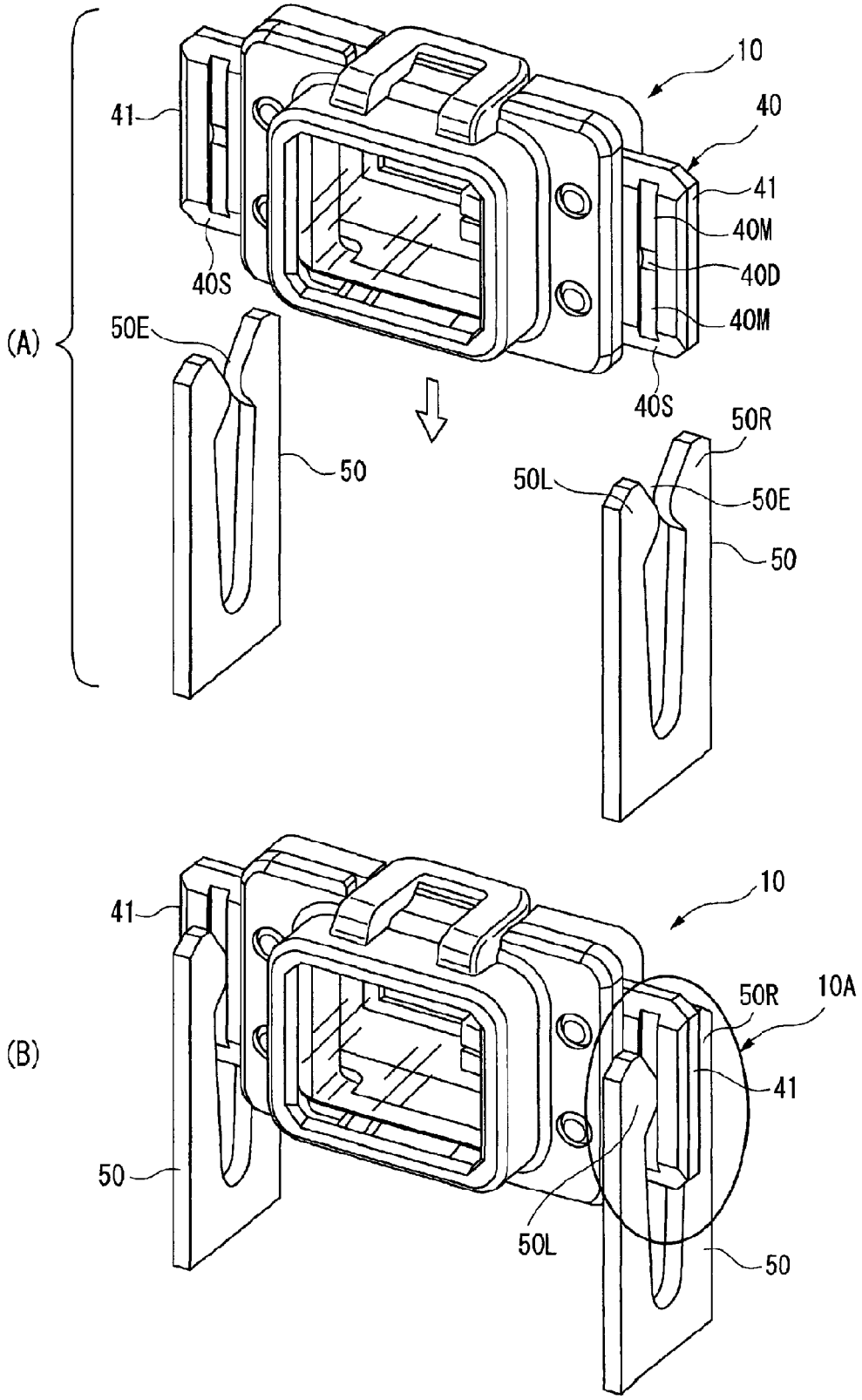
FIG. 9(A) is a perspective view of a state before the blade-type fuse of FIG. 8(A) is inserted into bifurcated terminals.
FIG. 9(B) is a perspective view of a state after the insertion.

FIG. 9(A) is a perspective view of a state before the blade-type fuse of FIG. 8(A) is inserted into the bifurcated terminals, and FIG. 9(B) is a perspective view of a state after the insertion. When the blade-type fuse 10 is lowered toward the two bifurcated terminals 50 in the lower side, the bifurcated tip parts 50R, 50L of the bifurcated terminals 50 are introduced into the terminal guide grooves 40M through the inclined portions 40S of the lower ends of the terminal portions 41, 41, respectively, and finally stop in the fitting recesses 40D. As a result, the electrical connection of the blade-type fuse 10 and the bifurcated terminals 50 is completed. FIG. 9(B) shows this state.

The terminal guide grooves 40M are formed in the strictly same manner also in the opposite side with respect to the fitting recesses 40D. When the blade-type fuse 10 of the second embodiment is to be inserted into the bifurcated terminals 50, therefore, the insertion can be performed without concern for the direction (the front side or the back side, the upper side or the lower side) of the blade-type fuse 10.

<Shape of Fitting Recesses 40D>

Figure 10:
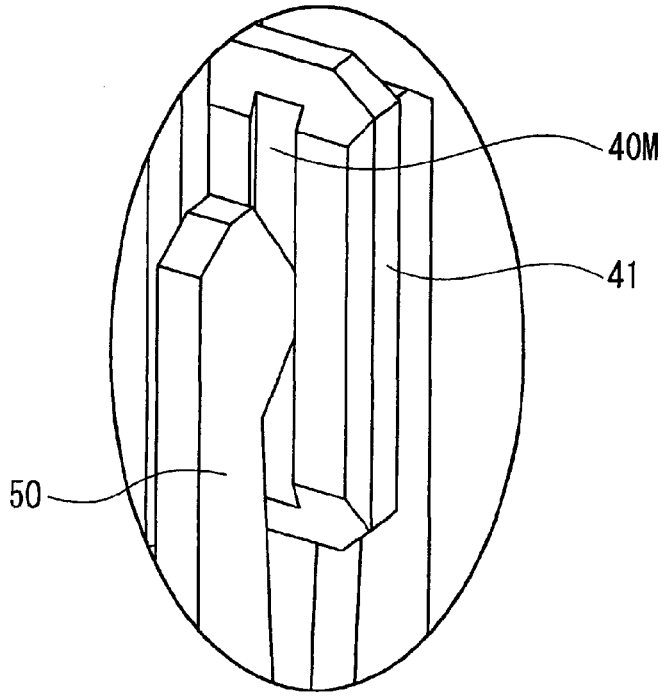
FIG. 10(A) is an enlarged view of the elliptic pattern 10A in FIG. 9(B)
FIG. 10(B) is a side view of a flat terminal portion in the second embodiment which is inserted into the bifurcated terminal.
Figure 10:
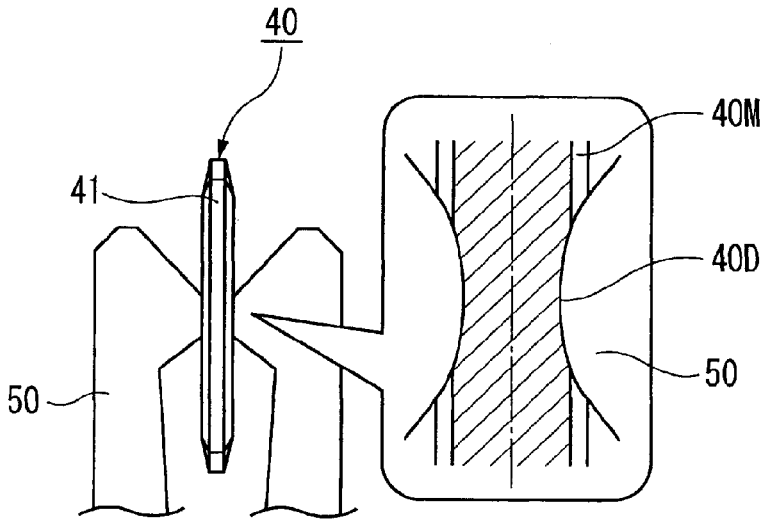

FIG. 10(A) is an enlarged view of the elliptic pattern 10A in FIG. 9(B), and FIG. 10(B) is a side view of a flat terminal portion in the second embodiment which is inserted into the bifurcated terminal. In the figure, the contact surfaces of each of the bifurcated tip parts 50R, 50L of the bifurcated terminal 50 has a curved surface C at the stop position where the flat terminal portions 41 are inserted into the bifurcated terminals 50 and stop, and curved surfaces D (FIG. 8(B)) which are coincident with the curved surfaces C (FIG. 3(A)) are formed in the fitting recesses 40D formed in the terminal guide grooves 40M of the terminal portion 4.

According to the present invention, although a point contact (FIG. 13(A)) is conventionally formed, as shown in FIG. 10(B), the curved surfaces C (C=D) of the bifurcated tip parts 50R, 50L of the bifurcated terminal 50 enter the fitting recesses 40D of the flat terminal portion 4 having the curved surfaces D, to make surface contact therewith. Therefore, the contact area is widened, so that the electric resistance is lowered, and heat generation is suppressed.

Since the bifurcated tip parts 50R, 50L of the bifurcated terminal 50 enter the fitting recesses 40D, the bifurcated tip parts 50R, 50L of the bifurcated terminal 50 do not slip off the fitting recesses 40D, and the flat terminal portion is stably held, so that flopping such as in FIG. 13(B)(2) does not occur.

Summary of Second Embodiment

According to the embodiment, as described above, the terminal guide grooves which guide the bifurcated tip parts of the bifurcated terminals are disposed in the flat terminal portions, the bifurcated tip parts of the bifurcated terminals are restricted into the terminal guide grooves. Therefore, the parts do not step out of the grooves, and rattling does not occur.

Since the fitting recesses are further formed in the terminal guide grooves, the bifurcated tip parts of the bifurcated terminals can be located easily and surely at the optimum positions of the flat terminal portions of the blade-type fuse.

Since the contact surfaces of the bifurcated tip parts of the bifurcated terminals are made identical in shape with the fitting recesses of the terminal guide grooves, the contact area is widened. Therefore, the electric resistance is lowered, and heat generation is suppressed.

Hereinafter, the features of the above-described embodiments of the blade-type fuse of the present invention are listed briefly and summarily in sections [1] to [4] below.

[1] A blade-type fuse (10) including: an upper casing (20); a lower casing (30) which is engaged with the upper casing (20); and a fuse body (40) having a fusible portion (42) which is housed between the upper casing (20) and the lower casing (30), and a flat terminal portion (41) which is exposed from between the upper casing (20) and the lower casing (30), wherein one of the upper casing (20) and the lower casing (30) includes a fixing post (30K), the other of the upper casing (20) and the lower casing (30) includes a through-hole (20K) through which the fixing post (30K) is passed, the flat terminal portion (41) includes a through-hole (40K) through which the fixing post (30K) is passed, and the flat terminal portion (41) is formed bilaterally symmetrically about a vertical line passing through a center of the blade-type fuse (10), and vertically symmetrically about a horizontal line passing through the center of the blade-type fuse (10).

[2] The blade-type fuse (10) according to [1], wherein a terminal guide groove (40M) which guides bifurcated tip parts (50R, 50L) of a bifurcated terminal (50) is disposed in the flat terminal portion (41) and extended in an insertion direction from a contact part of the terminal guide groove (40M) contact with the bifurcated terminal (50) when the flat terminal portion (41) is inserted.

[3] The blade-type fuse (10) according to [2], wherein fitting recesses (40D) are formed in parts of the terminal guide groove (40M) at which contact surfaces of the bifurcated tip parts (50R, 50L) of the bifurcated terminals (50) are positioned respectively in an optimum stop position state where the flat terminal portion (41) stops after being inserted into the bifurcated terminal (50).

[4] The blade-type fuse (10) according to [3], wherein the contact surfaces of the bifurcated tip parts (50R, 50L) of the bifurcated terminal (50) is made identical in shape with the fitting recesses (40D) of the terminal guide groove (40M), and in surface contact with each other.

Although the present invention has been described in detail and with reference to the specific embodiments, it is obvious to those skilled in the art that various changes and modifications can be made without departing from the spirit and scope of the present invention.

The present application is based on Japanese Patent Application No. 2011-227287 filed on Oct. 14, 2011, the contents of which are incorporated herein by reference.

INDUSTRIAL APPLICABILITY

The present invention relates to a fuse, and particularly is useful in the field of a blade-type fuse.

REFERENCE SIGNS LIST

10: blade-type fuse
20: insulating upper casing
20K: through-hole
20T: engagement piece
30: insulating lower casing
30K: fixing post
30T: engagement projection
30Y: rattling preventing rib
40: fuse body
40D: fitting recess
40K: through-hole
40M: terminal guide groove
40S: inclined portion
41: flat terminal portion
42: fusible portion
43: band-like coupling portion
44: supporting piece
45: low-melting-point metal chip
50: bifurcated terminal
50E: inlet opening
50R, 50L: bifurcated tip part

The invention claimed is:

1. A blade-type fuse comprising:
an upper casing;
a lower casing which is engaged with the upper casing; and
a fuse body having a fusible portion which is housed between the upper casing and the lower casing, and a flat terminal portion which is exposed from between the upper casing and the lower casing, wherein
one of the upper casing and the lower casing includes a fixing post, the other of the upper casing and the lower casing includes a through-hole through which the fixing post is passed, the flat terminal portion includes a through-hole through which the fixing post is passed,
the flat terminal portion is formed bilaterally symmetrically about a vertical line passing through a center of the blade-type fuse, and vertically symmetrically about a horizontal line passing through the center of the blade-type fuse, and
a terminal guide groove which guides bifurcated tip parts of a bifurcated terminal is disposed in the flat terminal portion and extended in an insertion direction from a contact part of the terminal guide groove in contact with the bifurcated terminal when the flat terminal portion is inserted.

2. The blade-type fuse according to claim 1, wherein
fitting recesses are formed in parts of the terminal guide groove at which contact surfaces of the bifurcated tip parts of the bifurcated terminals are positioned respectively in an optimum stop position state where the flat terminal portion stops after being inserted into the bifurcated terminal.

3. The blade-type fuse according to claim 2, wherein
the contact surfaces of the bifurcated tip parts of the bifurcated terminal are made identical in shape with the fitting recesses of the terminal guide groove, and the contact surfaces are in surface contact with the fitting recesses.

4. A blade-type fuse comprising:
at least one casing; and
a fuse body comprising a fusible portion housed within the at least one casing, and a flat terminal portion exposed relative to the at least one casing, wherein the flat terminal portion comprises a guide groove, wherein the guide groove guides bifurcated tip parts of a bifurcated terminal when the blade-type fuse is inserted into the bifurcated terminal, and
wherein the flat terminal portion is formed bilaterally symmetrically about a vertical line passing through a center of the blade-type fuse, and vertically symmetrically about a horizontal line passing through the center of the blade-type fuse.

5. The blade-type fuse according to claim 4, wherein the guide groove is vertically formed in the flat terminal portion.

6. The blade-type fuse according to claim 4, wherein the guide groove comprises a fitting recess having a surface coincident with a surface of the bifurcated tip parts of the bifurcated terminal.

7. The blade-type fuse according to claim 6, wherein the fitting recess is formed in the terminal guide groove at an optimum stop position of the bifurcated tip parts of the bifurcated terminal.

* * * * *